US008591132B2

(12) United States Patent
Hui

(10) Patent No.: US 8,591,132 B2
(45) Date of Patent: Nov. 26, 2013

(54) WRITING PEN WITH INK STORAGE

(75) Inventor: Ve Chung Hui, Hong Kong (HK)

(73) Assignee: Tung Yik International Ltd., Hong Kong (HK)

( * ) Notice: Subject to any disclaimer, the term of this patent is extended or adjusted under 35 U.S.C. 154(b) by 534 days.

(21) Appl. No.: 12/912,849

(22) Filed: Oct. 27, 2010

(65) Prior Publication Data

US 2012/0107036 A1 May 3, 2012

(51) Int. Cl.
*B43K 5/00* (2006.01)

(52) U.S. Cl.
USPC ..... 401/199; 401/198

(58) Field of Classification Search
USPC ..... 401/198, 199, 223, 224
See application file for complete search history.

(56) References Cited

U.S. PATENT DOCUMENTS 6,497,527 B2 * 12/2002 Kaufmann ..... 401/198
6,648,539 B2 * 11/2003 Dai ..... 401/198

* cited by examiner

*Primary Examiner* — David Walczak

(57) ABSTRACT

A writing pen with ink storage, including a writing nib, an ink storage compartment for storing ink, an ink inducing device for inducing ink into the writing nib, wherein the writing pen further includes an air pressure balancing plug which is plugged in an open end of the ink storage compartment to seal ink, and a breathable core having nanopores, the breathable core being inserted into the air pressure balancing plug with one end extending into ink and the other end communicating with ambient air. The writing pen with ink storage has simple structure, provides fluent writing and no ink leakage.

8 Claims, 3 Drawing Sheets

WRITING PEN WITH INK STORAGE

FIELD OF THE PATENT APPLICATION

The present patent application relates generally to writing instruments and more specifically, to a writing pen with ink storage, which has simple structure, provides fluent writing and no ink leakage.

BACKGROUND OF THE PATENT APPLICATION

Generally, a writing pen includes at least an ink storage device and an ink inducing device, wherein the ink storage device is used for storing liquid ink or even gelatin ink as an ink source, and the ink inducing device for inducing ink to the nib for the purpose of writing. As consumption of ink during writing, ambient air needs to be allowed into the ink storage device, otherwise vacuum pressure may be generated in the ink storage device and affect outflow of ink. That means, there should be an air communicating passage between the ink storage device and the ambient air to balance air pressure, which is a key point to ensure that the writing pen can provide fluent writing with no ink leakage.

China patent No. 01235948.3 discloses a writing pen with ink storage, which has a dust-proof plate, a labyrinth breathable plug, a nano-permeable plate and an one-way valve to achieve air communication between the ink storage device and ambient air. Such a writing pen can keep air pressure balance, but has some disadvantages such as complicated structure with many parts, too much assembly procedures and high manufacture cost.

SUMMARY

Aimed at disadvantages of complicated structure of the conventional writing pen with ink storage, the present patent application is intended to provide a writing pen with ink storage that has simple structure.

According to an aspect of the present patent application, a writing pen with ink storage is provided, including a writing nib, an ink storage compartment for storing ink, an ink inducing device for inducing ink into the writing nib, wherein the writing pen further includes an air pressure balancing plug which is plugged in an open end of the ink storage compartment to seal ink, and a breathable core having nanopores, the breathable core being inserted into the air pressure balancing plug with one end extending into ink and the other end communicating with ambient air.

In an embodiment of the present patent application, the ink inducing device includes a transfer core having one end being connected to the writing nib and a relay core connected to the other end of the transfer core, a tail end of said relay core passing through the air pressure balancing plug and entering into the ink. Further, the opposite ends of the relay core and the writing nib are located in the transfer core with an interval between each other.

In an embodiment of the present patent application, the writing pen further includes a pen body and a pen cap, the ink storage compartment and the ink inducing device are arranged at the tail end and the middle of the pen body respectively, while the writing nib is arranged at the front end of the pen body with a portion extending out of the front holder, and the pen cap is assembled at the front end of the front holder to cover the writing nib.

In an embodiment of the present patent application, the writing pen includes two breathable cores, including a first breathable core and a second breathable core, and the first breathable core extends into the transfer core. The air pressure balancing plug has three holes for the relay core, the first breathable core and the second breathable core to be inserted into respectively. The first breathable core contacts with the transfer core.

In an embodiment of the present patent application, diameter of the nanopores in the breathable core is larger than particle diameter of the ink. The diameter of the nanopores in the breathable core is 500 nm, and porosity of the breathable core is 50%.

Advantages of the writing pen with ink storage in accordance with embodiments of the present patent application lie in that: ambient air can be allowed into the ink storage compartment through the breathable cores having nanopores, while ink won't leak out of the ink storage compartment, therefore, air pressure in and out of the ink storage compartment can be kept balance, so the pen can provide fluent writing. The writing pen with ink storage of the present patent application utilizes breathable cores to replace the conventional air balancing assembly composed of many parts, thereby it has simple structure, low manufacture cost, and stable and reliable performance.

BRIEF DESCRIPTION OF THE DRAWINGS

The accompanying drawings illustrate one or more embodiments of the patent application and, together with the written description, serve to explain the principles of the patent application, and wherein.

DETAILED DESCRIPTION

These and other aspects of the present patent application will become apparent from the following description of the preferred embodiment taken in conjunction with the following drawings. It should be understood that the embodiments described here are only for the purposes of illustration and description and is not intended to be exhaustive or to limit the patent application to the precise forms disclosed.

Figure 1:
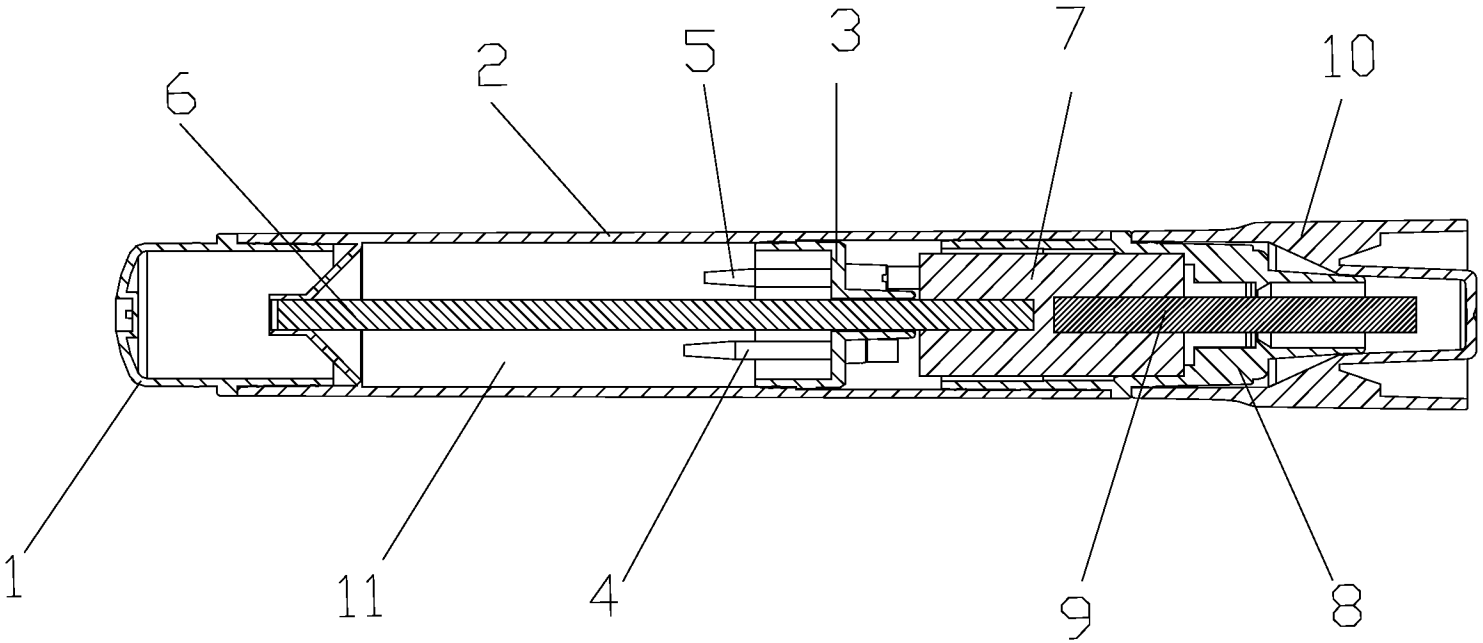
FIG. 1 is a structural diagram showing a writing pen with ink storage in accordance with an embodiment of the present patent application.
Figure 2:
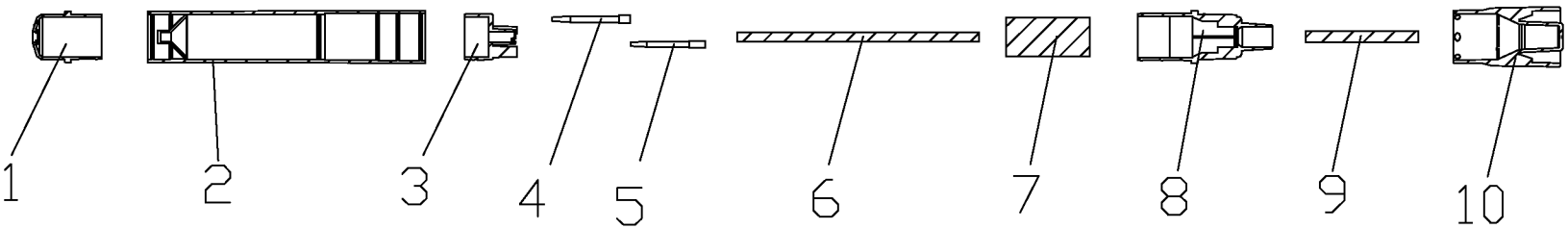
FIG. 2 is an exploded view showing parts of the writing pen as shown in FIG. 1.

As shown in FIG. 1 and FIG. 2, the writing pen with ink storage in accordance with an embodiment of the present patent application includes a fiber writing nib 9, a pen body 2, a front holder 8, a back holder 1, a pen cap 10, an ink storage compartment 11, an ink inducing device 12, an air pressure balancing plug 3 and breathable cores. The ink inducing device includes a transfer core 7 and a relay core 6 which is made of fiber materials. The breathable cores have cylindrical shape, and there are two breathable cores including a first breathable core 5 and a second breathable core 4, while the former is in communication with transfer core 7.

As shown in FIG. 1, the front holder 8 and the back holder 1 are assembled at two ends of the pen body 2 respectively. And in the pen body 2 are the ink storage compartment 11, the ink inducing device 12 and the writing nib 9 successively, while the ink storage compartment 11 is arranged in the tail end of the pen body 2 and the ink inducing device is arranged in the middle of the pen body 2. The writing nib 9 is arranged at the front end of the pen body 2 with a portion extending out of the front holder 8. The pen cap 10 is assembled at the front end of the pen body 2 and covers the writing nib 9. The ink inducing device 12 connects the ink storage compartment 11 and the writing nib 9 to induce ink from the ink storage compartment 11 to the writing nib 9. Ink in the ink storage compartment 11 may be fluorescent ink, marking ink, white-board ink, blackboard ink, correction fluid or any type of marking fluid.

Figure 3:
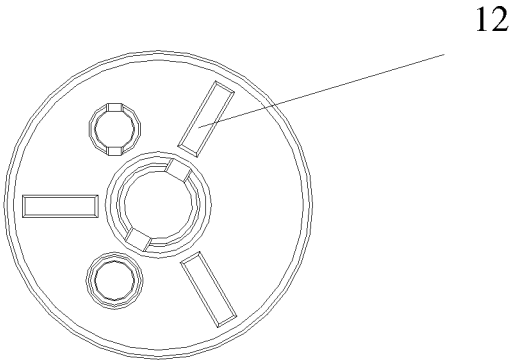
FIG. 3 is a structural diagram showing a pressure balancing plug in the writing pen as shown in FIG. 1.

The ink storage compartment 11 includes a closed end and an open end opposite to each other. The closed end of the ink storage compartment 11 is funnel shaped, and at the open end of the ink storage compartment 11 is a air pressure balancing plug 3, which is tightly fitted to the open end. As shown in FIG. 3, the air pressure balancing plug 3 has a through hole of 4 mm in diameter and two through holes of 2 mm in diameter. The relay core 6 passes through the 4 mm through hole and enters into the funnel shaped structure at the closed end of the ink storage pipe 11. The first breathable core 5 and the second breathable core 4 are inserted into the 2 mm through holes respectively, to enable their left end inserted into the storage compartment 11 and their right end to ambient air. Further, the first breathable core 5 is connected to the transfer core 7 to enhance the performance of inducing ink.

The breathable cores in the writing pen of embodiments of the present patent application are made of fiber materials treated by nanopore technology, thus the breathable cores are full of nanopores. Here the nanopores means that the nanopore has a diameter less than 1000 nanometers and measured as nm to be the measuring unit. In various embodiments of the present patent application, diameter of the nanopores is in a range of 400 to 800 nm, preferably 500 nm. Usually, particle diameter of ink is 300 to 350 nm, which is smaller than that of the nanopores, so that air passages are formed in the breathable cores. Besides, due to the selected proper pore diameter, the breathable cores have adequate capability of water absorption to prevent ink leakage. Porosity of the breathable core, i.e., a percentage rate of the total volume of all the nanopores to the volume of the breathable core, is in a range of 50 to 60%, and a preferred percentage is 55%, which can ensure fluent air flow.

The breathable cores and the relay core 6 are tightly mated with the through holes on the air pressure balancing plug 3 to prevent ink leakage. On the end surface of the air pressure balancing plug 3, three baffles 13 are arranged for fixing the distance from the transfer core 7.

The transfer core 7 is made of cotton batting, and is covered by a layer of plastic film surrounding its outer surface. Cotton batting has good performance of water absorption to prevent liquid leakage. The relay core 6 and the writing nib 9 are inserted into and connected with two ends of the transfer core 7 respectively, and the relay core 6 is spaced from the transfer core 7 with an interval, rather than directly contacts the transfer core 7. Such a design facilitates ink in the relay core 6 to first flow into the transfer core 7, then flow into the writing nib 9, in such a way ink flow in the pen tip 9 can be kept constant, and thus color of the handwriting is more uniform.

When writing with the writing pen with ink storage, liquid level in the ink storage compartment 11 drops, and negative pressure in the pipe increases, then ambient air enters into the ink storage compartment 11 through the breathable cores to achieve air pressure balance.

In various embodiments of the present patent application, the writing pen with ink storage realizes air pressure balance between the ink storage compartment 11 and ambient air by means of the two breathable cores and the air pressure balancing plug 3. The structure of the writing pen is simple, and manufacture process of the breathable cores is already mature, thus the cost is reduced greatly.

In various embodiments of the present patent application, number of the breathable cores is not limited to two as shown in the above described embodiment, there may be one or three or more breathable cores. Also, shape of the breathable cores is not limited to be cylindrical, but can be square or other shape. Additionally, the writing nib can be formed in various manners, such as a metal nib with a ball or others, etc. Therefore, the foregoing description of the exemplary embodiments of the patent application has been presented only for the purposes of illustration and description and is not intended to be exhaustive or to limit the patent application to the precise forms disclosed. Many modifications and variations are possible in light of the above teaching without departing from the protection scope of the present patent application.

What is claimed is:

1. A writing pen with ink storage, comprising a writing nib, an ink storage compartment for storing ink, an ink inducing device for inducing the ink into the writing nib, wherein the writing pen further comprises an air pressure balancing plug which is plugged in an open end of the ink storage compartment to seal the ink, and a breathable core having nanopores, the breathable core being inserted into the air pressure balancing plug with one end extending into the ink and the other end communicating with ambient air, and the ink inducing device comprises a transfer core having one end being connected to the writing nib and a relay core connected to the other end of the transfer core, a tail end of said relay core passing through the air pressure balancing plug and entering into the ink.

2. The writing pen with ink storage according to claim 1, wherein opposite ends of the relay core and the writing nib are located in the transfer core with an interval between each other.

3. The writing pen with ink storage according to claim 1, wherein the writing pen further comprises a pen body and a pen cap, the ink storage compartment and the ink inducing device are arranged at a tail end and middle of the pen body respectively, while the writing nib is arranged at the front end of the pen body with a portion extending out of a front holder, and the pen cap is assembled at a front end of the front holder to cover the writing nib.

4. The writing pen with ink storage according to claim 1, wherein the writing pen comprises two breathable cores, including a first breathable core and a second breathable core, and the first breathable core extends into the transfer core.

5. The writing pen with ink storage according to claim 4, wherein the air pressure balancing plug has three holes for the relay core, the first breathable core and the second breathable core to be inserted into respectively.

6. The writing pen with ink storage according to claim 4, wherein the first breathable core contacts with the transfer core.

7. The writing pen with ink storage according to claim 1, wherein diameter of the nanopores in the breathable core is larger than particle diameter of the ink.

8. The writing pen with ink storage according to claim 7, wherein the diameter of the nanopores in the breathable core is 500 nm, and porosity of the breathable core is 50%.

* * * * *